United States Patent [19]

Caron

[11] 4,271,557

[45] Jun. 9, 1981

[54] SHOCK ABSORBING FLOOR BRUSH ASSEMBLY

[75] Inventor: Beryl Caron, Los Angeles, Calif.

[73] Assignee: Zimmerman Brush Co., Chicago, Ill.

[21] Appl. No.: 33,886

[22] Filed: Apr. 27, 1979

[51] Int. Cl.[3] ..... A46B 13/02

[52] U.S. Cl. ..... 15/180; 15/28

[58] Field of Search ..... 15/180, 28, 29, 49 R, 15/48, 230.17, 230, 230.19; 51/68, 71, 72, 358, 384

[56] References Cited

U.S. PATENT DOCUMENTS

| | | | |
|---|---|---|---|
| 1,653,108 | 12/1927 | Koenig | 15/28 X |
| 1,787,528 | 1/1931 | Ivanovici | 51/177 |
| 1,984,205 | 12/1934 | Vinella | 51/177 |
| 2,443,001 | 6/1948 | Frendo | 15/28 |
| 3,233,272 | 2/1966 | Pambello | 15/182 |
| 3,348,254 | 10/1967 | Storm | 15/49 |
| 3,397,419 | 8/1968 | Okyn | 15/49 |
| 3,518,709 | 7/1970 | Zemke | 15/4 |
| 3,527,001 | 9/1970 | Kleemeier | 51/358 |
| 3,562,843 | 2/1971 | Belicko | 15/180 |
| 3,793,665 | 2/1974 | Thielen | 15/180 |
| 4,138,804 | 2/1979 | Thielen | 51/168 |

FOREIGN PATENT DOCUMENTS

| | | | |
|---|---|---|---|
| 404533 | 7/1970 | Australia | 15/180 |

*Primary Examiner*—Edward J. McCarthy

*Attorney, Agent, or Firm*—Neuman, Williams, Anderson & Olson

[57] ABSTRACT

A shock absorbing floor brush assembly for attachment with high-speed floor cleaning machines is provided having a rigid brush disk movably mounted on a shock absorbing hub so that the brush disk rotates with a floating action. The shock absorbing hub is of smaller diameter than the brush disk and has a drive disk with a conventional attachment clutch plate mounted on its top side and fasteners surrounded by resilient material extending from its underside. These fasteners hold the rigid brush disk, when stationary, in parallel relationship with the drive disk but permit the brush disk to move upward during use. The particular construction of the floor brush assembly enables the resilient material to absorb the upward and torque shocks encountered when cleaning a floor and to return the brush disk to its parallel relationship with the drive disk without transmitting the shocks to the floor cleaning machine and its operator. The shock absorbing characteristics are adjustable and controllable by adjusting the fasteners to provide a predetermined steady state load on the resilient material.

10 Claims, 5 Drawing Figures

SHOCK ABSORBING FLOOR BRUSH ASSEMBLY

This invention relates generally to brushes, and more particularly to brushes that scrub, clean, and polish floors.

BACKGROUND OF THE INVENTION

Brushes used for cleaning floors have been generally known for many years. The brush art has progressed from manually operated brushes, limited by human endurance, to machine driven brush units that are capable of cleaning large floor areas in a short time with a minimum amount of human effort. The rotary brush units described hereinafter comprise one type of machine unit. In general, these machines employ a generally flat disk which is supported above the floor surface by stiff brush fibers or the like. A circular pad of scrubbing or polishing material such as synthetic fibers, steel wool or the like are engaged and held by the brush fibers and rotate therewith. It is this pad which engages the floor and carries cleaning compounds and does the actual work on the floor surface. The center of the disk is secured to the generally vertical shaft of a power unit such as an electric motor and the housing of the power unit has a handle extending upwardly and outwardly from the disk axis. An operator uses the handle to control the unit and by tipping the unit, he can cause it to move across the floor, to the left or right, or forward or backward.

Within the last few years, the floor cleaning industry has developed new high-speed rotary floor cleaning machines. These new high-speed machines operate in a range near 300 revolutions per minute whereas earlier floor cleaning machines operate in a range near 175 revolutions per minute. With the advent of the new high-speed machines, a number of new problems have arisen relating to the structure and durability of the brushes. It has been found that the brushes used on the earlier machines are not suitable, nor are they safe for use on the new high-speed machines. Because the new machines operate at such high speeds, a tremendous amount of torque is generated, particularly in starting up the machine and when the brush encounters localized resistance especially under only a portion of the disk. Should the direction of the torque due to the driving force be altered upon encountering resistance, the results could be disasterous. For example, if the brush driven at high speed encounters a rough floor or a particularly sticky substance on the floor, the balanced torque is transformed into a violent moment where the moment arm is the distance from the center of the power unit to the point where the resistance is encountered. This moment produces a vibration of the entire machine, rapid acceleration of the machine across the floor or the brush itself breaks down hurling bits and pieces helter-skelter. Thus, the operator of the machine and anyone or anything in the vicinity is imperiled. Furthermore, lesser resistance causes a chatter of the working brush surface producing unsatisfactory polishing or cleaning. Similarly small discontinuities in the floor surface will produce brush chatter and render the machine hard to control. Such chatter will also reduce the quality of the work done by the machine.

To avoid the dangerous possibilities and optimize the quality of the work, it has been found that the brushes used on the high-speed machines must be more durable and must reduce the vibration transferred to the machine. Basically, vibration under a uniform balanced load is reduced by delicately spin balancing the brush. By incorporating some type of shock absorbing means into the brush, the vibration resulting from load changes can also be reduced. One shock absorbing means presently used for brushes designed to operate on high-speed machines employs plastic spines extending downwardly from an integral flexible plastic back supported by a polyurethane foam disk on a rigid disk of equal diameter such as 24 inches. The high-speed machine rotates the sandwich of rigid disk, foam disk flexible support, spines and any polishing fabric below the spines and carried thereby very near the floor so that the sandwich should be compressed to absorb the shocks caused by the torque directional changes occurring when brush resistance or floor irregularities are encountered.

Although the sandwich construction described above has resulted in some improvement, new problems have arisen that heretofore have remained unsolved. For example, because the entire sandwich including the polyurethane foam disk is positioned so near the floor when the floor cleaning machine is in operation, the foam disk frequently contacts the cleaning solutions and other obstacles on the floor that cause a deterioration of the foam or a tearing away of portions of the foam disk. These destructions of the foam disk upset the delicate spinning balance needed with this type of brush, as well as significantly reducing its shock absorbing capabilities. In addition, since the entire sandwich including the foam disk has the full diameter of the brush and the foam disk must be thick enough to absorb most shocks, the diameter of the brush surface must be substantially less than the diameter of the machine's bell housing which covers the rotating brush. This precaution avoids contact between the brush and bell housing. Thus, the machine is unable to clean the floor closely adjacent to the walls and the machine is generally less efficient. Furthermore, the use of the large foam disk is costly, creates construction problems, requires extremely careful bonding and lowers responsiveness and power transmitting capabilities. The present invention solves the problems that have been found in the prior art and provides a shock absorbing brush with a rigid brush construction to operate safely on high-speed floor cleaning machines. It is an object of the present invention to provide a floor cleaning brush that has a unique shock absorbing and power transmission means removed from a position where it contacts cleaning solutions or obstacles on the floor.

Another object of the present invention is to increase the cleaning efficiency of high-speed machine driven brushes by providing a rigid brush mounted on a shock absorbing means which provides positive reliable power transmission.

Another object of the present invention is to provide an improved brush construction providing optimum torque transmission characteristics with controllable or adjustable shock absorption.

A further object of the present invention is to provide a brush that is safe to use at high revolving speeds by providing a construction that reduces the torque stress on the machine and brush and thereby reduces machine maintenance and machine vibration.

Still another object of the present invention is to provide a more durable brush that is less expensive to construct than the presently used brushes.

A further object of the present invention is to provide a brush that cleans the floor area within a minimum distance from the walls.

Other objects and advantages of the invention will become apparent upon reading the following detailed description and appending claims, and upon reference to the accompanying drawings.

SUMMARY OF THE INVENTION

The shock absorbing floor brush of this invention has a rigid disk with bristles extending outwardly from its underside, said rigid disk is mounted on a shock absorbing hub assembly including connecting means for driving the rigid disk. The shock absorbing hub assembly has a conventional clutch plate, a drive disk, a plurality of fasteners, and a resilient means. The clutch plate, adapted for attachment to high-speed floor cleaning machines, is mounted to the topside of the drive disk. Affixed to the drive disk are a plurality of fasteners, such as bolts, which extend from the underside of the drive disk to movably secure the rigid brush disk within a limited outward displacement from the drive disk. The resilient means, which may comprise a sponge rubber disk, a polyurethane foam disk, a plurality of coil springs, or a combination thereof, is disposed between the drive and brush disks and about the fasteners so as to absorb the shocks transmitted by the brush disk when it encounters resistance and to resiliently maintain a spaced relationship between the disks which is variable between a predetermined minimum and a predetermined maximum spacing. While in the static state, the disks will be in a substantially parallel relationship. The resilient means will permit nonuniform displacement of the disks towards one another to place the disks in a transient skewed relationship.

The present invention's construction gives the rigid brush disk a floating action that enables the brush to efficiently clean the floor while the hub assembly absorbs the shocks that occur. The diameter of the hub assembly approximates the diameter of the clutch plate so that the length of the moment arm to the mass center is reduced thereby significantly reducing the amount of torque stress for a given brush diameter. Also, since the resilient element is removed from contact with obstacles on the floor or cleaning solutions, it is not subjected to the abuses that frequently cause damage and deterioration.

BRIEF DESCRIPTION OF THE DRAWINGS

For a more complete understanding of this invention, reference should now be made to the embodiments illustrated in greater detail in the accompanying drawings and described below. In the drawings.

DETAILED DESCRIPTION OF THE PREFERRED EMBODIMENTS

Figure 1:
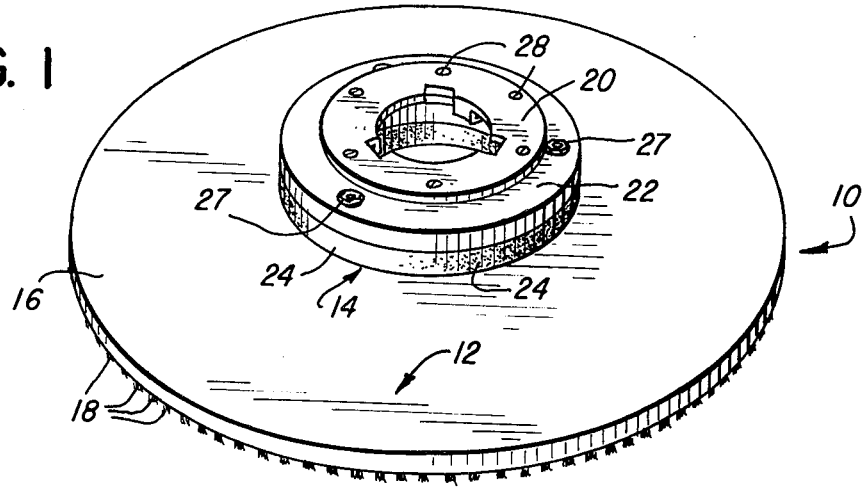
FIG. 1 is a top perspective view of a shock absorbing brush showing the clutch plate attached to the brush assembly.

Referring generally to the drawings, a shock absorbing brush assembly 10 for attachment with a floor cleaning machine may be used to scrub, clean and polish floors. The brush assembly 10 has a floating brush disk 12 movably mounted on a shock absorbing hub 14. The brush disk 1 comprises a rigid back portion 16 with a multiplicity of brush elements or bristles 18 extending outwardly from its underside. The shock absorbing hub 14 comprises a clutch plate 20, a drive disk 22, a resilient material 24, and a plurality of fasteners 26.

Figure 4:
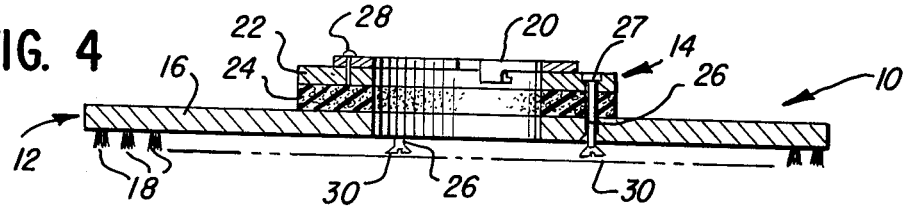
FIG. 4 is a vertical section view along the line 4—4 of FIG. 3 showing a preferred embodiment of the shock absorbing brush, in a fully compressed state, wherein the brush disk is movably secured to the drive disk by fastening means which protrude beyond the brush disk when the resilient material is compressed; and, FIG. 5 is a vertical section view along the line 4—4 of FIG. 3 showing another embodiment of the shock absorbing brush wherein coil springs are disposed about the fastening screws for resilience.

As shown in FIGS. 1 and 4, the shock absorbing hub 14 has a clutch plate 20 firmly secured to the topside of a drive disk 22 by mounting screws 28 or some other suitable mounting means and a resilient material 24 contacting the underside of the drive disk 22. The clutch plate 20 is used to accommodate locking engagement with the attachment and drive mechanism of a rotary floor cleaning machine (not shown). Since there are many types of floor cleaning machines and attachment mechanisms, the clutch plate 20 may take any of a number of forms or configurations designed to receive such mechanisms, but an annular form which attaches to the vertical shaft of the machine such as shown in FIG. 1 is preferred.

The drive disk 22 is of a diameter only slightly larger than the clutch plate 20 and is made of a sturdy rigid and durable material, such as wood or metal, although other materials may be used. This drive disk 22 transmits the floor cleaning machine's rotating drive force via a connecting means such as fasteners 26 which are affixed to and extend from the underside of the drive disk 22 (see FIG. 4) to the brush disk 12 which travels the floor. The manner in which the fasteners 26 are secured to the drive disk 22 depends on the particular design and design criteria. In the described embodiment, nuts 27 are secured in the drive disk 22 to threadedly receive the fasteners 26. The rigid back portion 16 of the brush disk 12 is movably mounted about these fasteners 26 so that it is held with bristles 18 downward in spaced subtending relation to the drive disk 22 and with the resilient material 24 disposed therebetween. The fasteners 26, having heads 30 which abut the underside of the rigid back 16, limit the outward displacement of the brush disk 12 from the drive disk 22 and provide a sliding engagement upon which the brush disk 12 may move towards the drive disk 22. It is preferred that the fasteners 26 be screws or bolts adjustable in length, however, it should be understood that any suitable fastening means may be employed. For example, the fastening means may be arranged in reverse such that the fasteners 26 are affixed to the brush disk 12 and movably mounted through the drive disk 22.

The resilient material 24 disposed between the drive disk 22 and the rigid back portion 16 of the brush disk 12 compresses to absorb the shocks caused by skewed movement of the rigid back 16 towards the drive disk 22 when the brush assembly 10 encounters obstacles or resistance in operation. Thus, the brush disk 12 is free to move in a floating action on the fasteners 26 with the resilient material 24 compressing and absorbing the shocks due to that movement. The resilience and the thickness of the material 24 is such that it is fully compressed before the fasteners 26 contact the floor by protruding beyond the compressed bristles 18. See FIG. 4. It is preferred that the resilient material 24 be a disk of sponge rubber which corresponds in diameter to the drive disk 22 and surrounds the fasteners 26. However, other resilient materials in various sizes and shapes may be used, for example, a disk of polyurethane foam could be suitable. When adjustable fasteners 26 are used, the resilience of the material 24 can be adjusted and controlled by tightening or loosening said fasteners 26.

Figure 5:
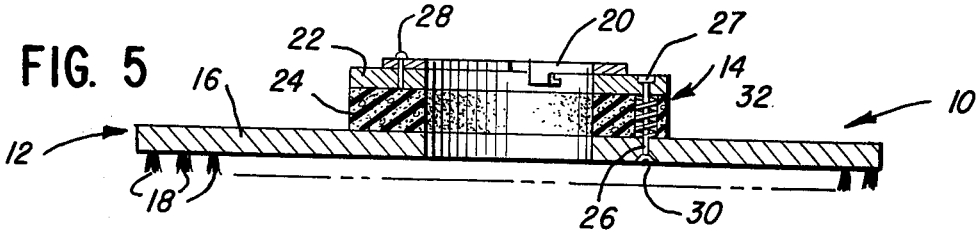

Another preferred embodiment of the brush assembly 10 has resilient material 24 which is coil springs 32 mounted around the fasteners 26 and disposed between the rigid back 16 and the drive disk 22. The coil springs 32 of this embodiment may be used alone or in conjunction with other resilient material 24 such as sponge rubber or polyurethane foam, as shown in FIG. 5.

Figure 2:
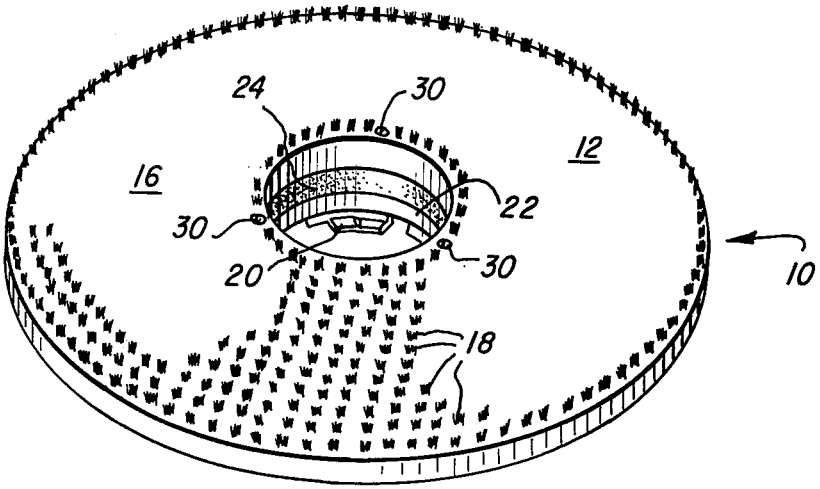
FIG. 2 is a bottom perspective view of the shock absorbing brush showing the bristles and the fastening means.
Figure 3:
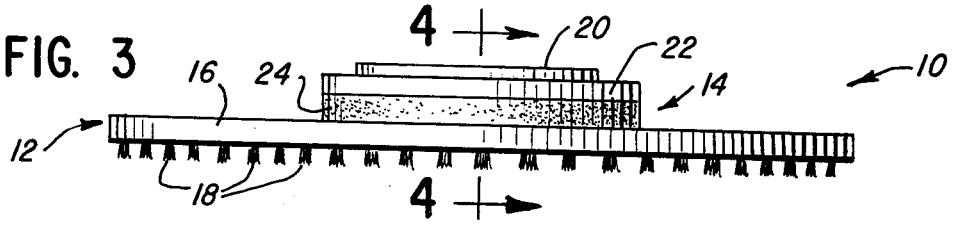
FIG. 3 is an elevational view of the shock absorbing brush showing the resilient material, in a noncompressed state, between the drive disk and the brush disk.

As illustrated principally in FIGS. 2 and 3, the brush disk 12 has bristles 18 extending outwardly from the underside of a rigid back portion 16 which is movably secured in concentric spaced relation to the drive disk 22 by fasteners 26. The interposed resilient material 24 enables the rigid back 16 to move, within limits, along the fasteners 26, thereby providing a floating action of the rigid back 16 in relation to the drive disk 22. Because the brush assembly 10 operates on this floating action principle about a shock absorbing hub 14, the brush disk 12 may be and preferably is constructed to have a diameter substantially larger than the drive disk 22. Thus, the torque stress on the brush assembly 10 and particularly the brush disk 12 is significantly reduced because the moment arm of the torque transmittal force is reduced. This, in addition to the reduced thickness of the rigid back 16 and bristles 18 over brushes presently used, permits the brush disks 12 to be constructed of even greater diameter than such other brushes enabling the brush assembly 10 to clean at a minimum distance form the wall when used in conjunction with the present floor cleaning machines. By adjusting the fasteners 26 and having a resilient material 24 of uniform thickness, the resiliency of the material 24 can be controlled and the rigid back 16 can be held in a static state of parallel spaced relation to the drive disk 22 especially if the material 24 is slightly compressed. The rigid back 16 and bristles 18 of the brush disk 12 may be made of any appropriate materials, but wood for the rigid back 16 and nylon for the bristles 18 is preferred.

Another embodiment of the brush assembly 10 of this invention has coil springs 32 having one end affixed to the underside of the drive disk 22 and a second end affixed to the topside of the rigid back portion 16 of the brush disk 12. In this embodiment, the coil springs serve not only to provide resilience, but also to secure the brush disk 12 in spaced relation to the drive disk 22, thus, rendering the fasteners 26 unnecessary. However, with this embodiment, there is no means to adjust the resilience of the coil springs 32.

In operation, the brush assembly 10 of this invention absorbs most of the shocks and start up stresses incident to cleaning a floor with a floor cleaning machine. Although the brush assembly 10 is designed to withstand the special strains of operation on the new high-speed floor cleaning machines, it is to be understood that the brush assembly is also suitable for use on low-speed machines. The particular construction of the brush assembly 10 overcomes several of the problems encountered by other brushes. For example, the floating action of the brush disk 12 on the shock absorbing hub 14 coupled with the securing fasteners 26 which limit the displacement of the brush disk 12 absorb most of the start up torque stresses without the resilient material 24 bearing the full burden of these stresses. Most of the start up stresses are borne by the fasteners 26 or are transmitted through the fasteners 26 to the rigid back portion 16 of the brush disk 12 without significantly stretching or twisting the resilient material 24. Thus, the brush disk 12 is driven without much, if any, lag behind the drive mechanism. Such a lag creates a moment of resistance which is a particularly acute problem encountered by brushes with flexible backed spines supported by a polyurethane foam pad because the foam disk tends to stretch under the twisting force and lag behind the drive mechanism. Thus, the foam disk must bear the entire force of that resisting moment and is frequently weakened or torn. Another problem confronting the flexible backed bristle brush is that the entire sandwich of components including the polyurethane foam pad is disposed so near the floor in operation that it is exposed to the active cleaning solutions which may cause deterioration of the foam pad or the plastic spines. Such deterioration will cause pieces of the pad or flexible backed spines to tear loose and to be hurled from the machine destroying the delicate balance of the brush and endangering persons and things in the operating machine's vicinity. The brush assembly 10 of this invention does not have these problems because the resilient material 24, being of smaller diameter than the brush disk 12, is insulated from the cleaning solutions by the rigid back portion 16 of the brush disk 12 and the rigid back 16 is secured by fasteners 26 to the shock absorbing hub 14 rather than being secured solely by a bonding adhesive. Thus, the brush disk 12 will remain positively secured to the drive disk 22 even if the resilient material 24 should deteriorate, and the likelihood that portions of the brush assembly 10 will be torn off and hurled from the machine are drastically reduced. Because the shock absorbing hub 14 of this invention is of lesser diameter than the brush disk 12, most of the stresses and strains are concentrated in an area closer to the center of the brush disk 12. This minimizes the torque stresses on the brush assembly 10 and the substantial tension which must be borne by the connecting means at the relatively small diameter is borne by the fastening means not by the resilient means. The length of the moment arm to the mass center is reduced minimizing the need for delicate balancing because imperfections in the balancing will not be as readily felt as with brushes presently being used.

In addition, the brush assembly 10 is sturdy and is easily constructed of relatively inexpensive materials arranged to withstand the stresses of operation with a high-speed floor cleaning machine.

While particular embodiments of the invention have been shown, it will be understood, of course, that the invention is not limited thereto since modifications may be made by those skilled in the art, particularly in light of the foregoing teachings. It is, therefore, contemplated by the appended claims to cover any such modifications which incorporate the essential features of and are within the true spirit and scope of the invention.

What is claimed is:

1. A brush capable of being secured to the central vertical shaft of a rotary floor cleaning machine which comprises:

a drive disk;

means for coupling said drive disk to the machine shaft;

a brush disk spaced from and in concentric, substantially parallel planar relationship to said drive disk, said brush disk having a rigid back portion having a lower surface with flexible brush elements extending outwardly from said lower surface; and, connecting means interposed between and connected to said drive disk and said brush disk to transmit torque therebetween and to resiliently absorb vertical, horizontal and torque shocks and stresses, comprising:

resilient means interposed between said drive disk and said brush disk for absorbing shocks and stresses and urging said drive disk and said brush disk apart; and, fastening means for securing said brush disk in spaced subtending relationship to said drive disk and limiting the resilient separation thereof by said resilient means, comprising:

a plurality of fasteners each having a first end affixed to said drive disk and a second end extending through said brush disk and limiting the outward displacement of said brush disk from said drive disk; said brush disk slidably movable on said fasteners for permitting substantial vertical limited relative movement of said brush disk towards said drive disk.

2. A brush as set forth in claim 1 wherein said resilient means when under force is fully compressed before said second end of a fastener protrudes beyond the fully compressed brush elements of the brush disk thereby preventing said fastener assembly from contacting the floor.

3. A brush as set forth in claim 1 wherein said resilient means comprises a coil spring disposed about each fastener assembly for absorbing shocks and stresses.

4. The brush of claim 1 wherein said fastening means is adjustable to adjust the compression of said resilient means while permitting selective additional compression of said resilient means whereby the spacing between said disks is reduced.

5. A brush capable of being secured to the central vertical shaft of a rotary floor cleaning machine which comprises:

a drive disk;

means for coupling said drive disk to the machine shaft;

a brush disk spaced from and in concentric, substantially parallel planar relationship to said drive disk, said brush disk having a rigid back portion having a lower surface with flexible brush elements extending outwardly from said lower surface; and, connecting means interposed between and connected to said drive disk and said brush disk to transmit torque therebetween and to resiliently absorb vertical, horizontal and torque shocks and stresses, comprising:

resilient means interposed between said drive disk and said brush for absorbing shocks and stresses and urging said drive disk and said brush disk apart; and, fastening means for securing said brush disk in spaced subtending relationship to said drive disk and limiting the resilient separation thereof by said resilient means, comprising:

a plurality of fasteners each having a first end affixed to said brush disk and a second end extending through said drive disk and limiting the outward displacement of said drive disk from said brush disk; said drive disk slidably movable on said fasteners for permitting substantial vertical limited relative movement of said brush disk towards said drive disk.

6. A brush as set forth in claim 5 wherein said resilient means when under force is fully compressed before said second end of a fastener protrudes upward far enough to contact the machine.

7. A brush as set forth in claim 5 wherein said resilient means comprises a coil spring disposed about each fastener assembly for absorbing shocks and stresses.

8. A brush as set forth in claim 5 wherein said fastening means is adjustable to adjust the compression of said resilient means while permitting selective additional compression of said resilient means whereby the spacing between said disks is reduced.

9. A brush capable of being secured to the central vertical shaft of a rotary floor cleaning machine which comprises:

a drive disk;

means for coupling said drive disk to the machine shaft;

a brush disk spaced from and in concentric, substantially parallel planar relationship to said drive disk, said brush disk having a rigid back portion having a lower surface with flexible brush elements extending outwardly from said lower surface; and, connecting means interposed between and connected to said drive disk and said brush disk to transmit torque therebetween and to resiliently absorb vertical, horizontal and torque shocks and stresses, comprising:

resilient means interposed between said drive disk and said brush disk for absorbing shocks and stresses and urging said drive disk and said brush disk apart; and, fastening means for securing said brush disk in spaced subtending relationship to said drive disk and limiting the resilient separation thereof by said resilient means, comprising:

a plurality of fasteners each having a first end connected to said drive disk and a second end connected to said brush disk, one of said ends extending through the associated disk and limiting the relative outward displacement of said brush disk from said drive disk; said associated disk slidably movable on said fasteners for permitting substantial vertical limited relative movement of said associated disk towards the other disk.

10. A brush capable of being secured to the central vertical shaft of a rotary floor cleaning machine which comprises:

a drive disk;

means for coupling said drive disk to the machine shaft;

a brush disk spaced from and in concentric, substantially parallel planar relationship to said drive disk, said brush disk having a rigid back portion having a lower surface with flexible brush elements extending outwardly from said lower surface; and, connecting means interposed between and connected to said drive disk and said brush disk to transmit torque shocks and stresses, comprising:

resilient means interposed between said drive disk and said brush disk for absorbing shocks and stresses and urging said drive disk and said brush disk apart; and, fastening means for securing said brush disk in spaced subtending relationship to said drive disk and limiting the resilient separation thereof by said resilient means, comprising:

a plurality of fasteners each having a first end connected to said drive disk and a second end connected to said brush disk, said plurality of fasteners limiting the relative outward displacement of said brush disk and drive disk; said fasteners permitting substantial vertical limited relative movement of said brush disk and said drive disk toward one another.

* * * * *